US009636570B2

(12) United States Patent
Ruiz et al.

(10) Patent No.: US 9,636,570 B2
(45) Date of Patent: May 2, 2017

(54) LOVE ADVENTURE BOARD GAME

(71) Applicants: Enrique Emanuel Ruiz, Clarksburg, MD (US); Sarah Witham Ruiz, Clarksburg, MD (US)

(72) Inventors: Enrique Emanuel Ruiz, Clarksburg, MD (US); Sarah Witham Ruiz, Clarksburg, MD (US)

( * ) Notice: Subject to any disclaimer, the term of this patent is extended or adjusted under 35 U.S.C. 154(b) by 0 days.

(21) Appl. No.: 14/196,276

(22) Filed: Mar. 4, 2014

(65) Prior Publication Data

US 2016/0361624 A1 Dec. 15, 2016

Related U.S. Application Data

(60) Provisional application No. 61/814,318, filed on Apr. 21, 2013.

(51) Int. Cl.
*A63F 3/00* (2006.01)

(52) U.S. Cl.
CPC *A63F 3/00006* (2013.01); *A63F 2003/00018* (2013.01); *A63F 2003/00107* (2013.01); *A63F 2003/00381* (2013.01); *A63F 2003/00716* (2013.01); *A63F 2003/00747* (2013.01); *A63F 2250/34* (2013.01)

(58) Field of Classification Search
CPC ..... A63F 3/0006; A63F 2003/00381; A63F 2003/00716; A63F 2250/34
USPC ... 273/141 R, 250, 251, 252, 254, 271, 277, 273/278, 279, 282.1, 289, 290
See application file for complete search history.

(56) References Cited

U.S. PATENT DOCUMENTS 3,104,106 A * 9/1963 Kenney ..... A63F 3/0415 273/248
3,468,540 A * 9/1969 Mulligan ..... A63F 3/001 273/141 R
4,569,526 A * 2/1986 Hamilton ..... A63F 3/00176 273/237
5,120,066 A * 6/1992 Cohen ..... A63F 3/0423 273/258
5,409,234 A * 4/1995 Bechter ..... A63F 3/00214 273/241
6,619,661 B1 * 9/2003 Collins ..... A63F 9/10 273/157 R (Continued)

*Primary Examiner* — Vishu Mendiratta
(74) *Attorney, Agent, or Firm* — Edell, Shapiro & Finnan, LLC

(57) ABSTRACT

A game designed to promote communication and encourage partners to build stronger relationships. The game includes a game board, dice, game pieces, skill connector pieces, love chips, friendship gems, and instructional game cards. The game board includes a track having spaces identifying relationship skills of compromise, independence, intimacy, and support. The track also includes spaces identifying reflective life skills of love, reignite, encourage, night-out and doghouse. Each game piece comprises two complementary player pieces having a handle and a contoured base. The skill connector pieces are configured as sections of a jigsaw puzzle that interlock with complementary jigsaw puzzle sections to form a ring-shaped puzzle. Each puzzle section corresponds to one of the relationship skills identified on the track. The instructional game cards include gamble, love, intimacy, and encouragement cards. When the ring-shaped puzzle is completely assembled, the game is won.

16 Claims, 10 Drawing Sheets

(56) References Cited

U.S. PATENT DOCUMENTS

| | | | | |
|---|---|---|---|---|
| 6,685,187 | B1 * | 2/2004 | Kline | A63F 3/00006 273/236 |
| 2004/0113362 | A1 * | 6/2004 | Hardwicke | A63F 3/0478 273/242 |
| 2009/0275003 | A1 * | 11/2009 | Green | A63F 3/0478 434/127 |

* cited by examiner

LOVE ADVENTURE BOARD GAME

CROSS REFERENCE TO RELATED APPLICATIONS

The present application is a non-provisional application based on and claiming priority from U.S. Provisional Application No. 61/814,318, entitled "Love Is Lost Adventure Board Game" filed Apr. 21, 2013, the disclosure which is hereby incorporated herein by reference in its entirety.

BACKGROUND OF THE DISCLOSURE

A board game is a game that involves counters or pieces moved or placed on a pre-marked surface or "board", according to a set of rules. Games can be based on pure strategy, chance (e.g. rolling dice), or a mixture of the two, and usually have a goal that a player aims to achieve. Board games have been around since ancient times, with the earliest known board games going back to as early as the 3500 BCE, in both Egypt and Persia.

There are many different types and styles of board games. Their representation of real-life situations can range from having no inherent theme, as with checkers, to having a specific theme and narrative, as with Cluedo. Rules can range from the very simple, as in Tic-tac-toe, to those describing a game universe in great detail, as in Dungeons & Dragons (although most of the latter are role-playing games where the board is secondary to the game, serving to help visualize the game scenario.

BRIEF DESCRIPTION OF THE DISCLOSURE

The present disclosure is for a game designed for couples. More specifically, this is a Love Adventure board game designed to keep a relationship vital and strong, and make the relationship seem like a treasure hunt during the game. The game helps couples discover what they are doing right in a relationship and what they can do better, while having lots of fun along the way. The board playing paradigm is win-win versus win-lose found in most games. To win the game, couples must help each other earn four critical skills of Compromise, Intimacy, Support and Independence. Players play individually and win as a couple. Throughout the game the partners will gain or lose Love chips based on the actions of one player. When both players cooperate and strategize, they both win although all other couples playing will experience new thoughts and insights to help strengthen their own relationship in the process In one embodiment, the goal of the game is to earn all relationship skills found on the game board. The first couple to win the relationship skills wins the game.

In yet another embodiment of the disclosure, a couple can play against each other yet win as a couple.

In one embodiment of the disclosure, the game comprises a board, a set of dice, player pieces, and playing instructions.

In another embodiment of the disclosure, the game further comprises at least one set of instructional cards.

In another embodiment of the disclosure, the game further comprises a ring having a plurality of parts.

In one embodiment of the disclosure the game comprises Love chips.

In yet another embodiment of the disclosure, the game further comprises a plurality of gems.

BRIEF DESCRIPTION OF THE FIGURES

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION OF THE DISCLOSURE

Figure 1:
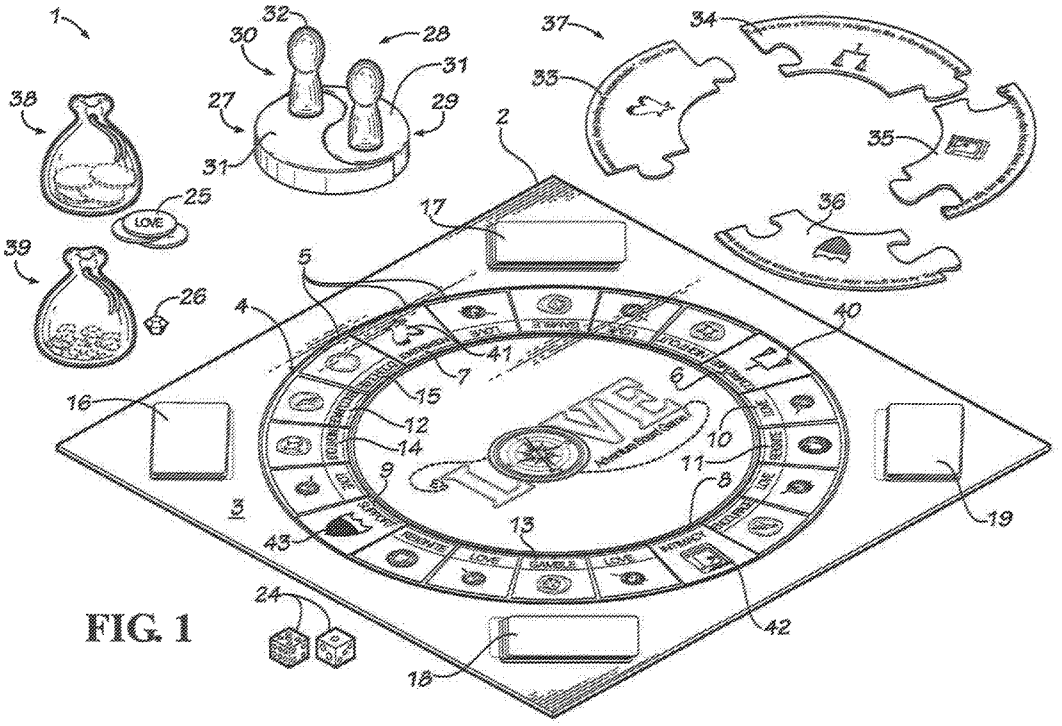
FIG. 1 is a perspective view of the entire game.
Figure 2:
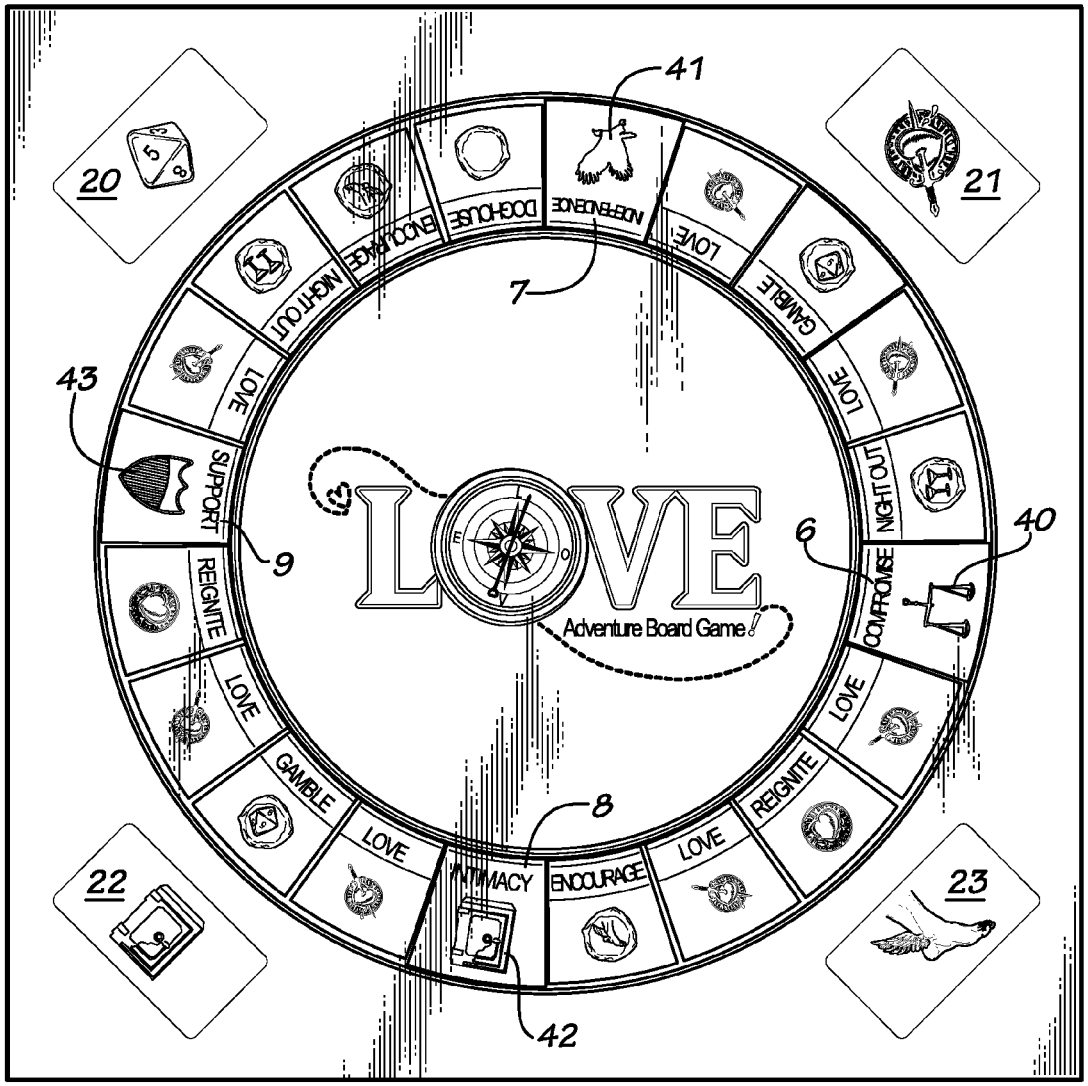
FIG. 2 is an overhead view of the board.
Figure 3:
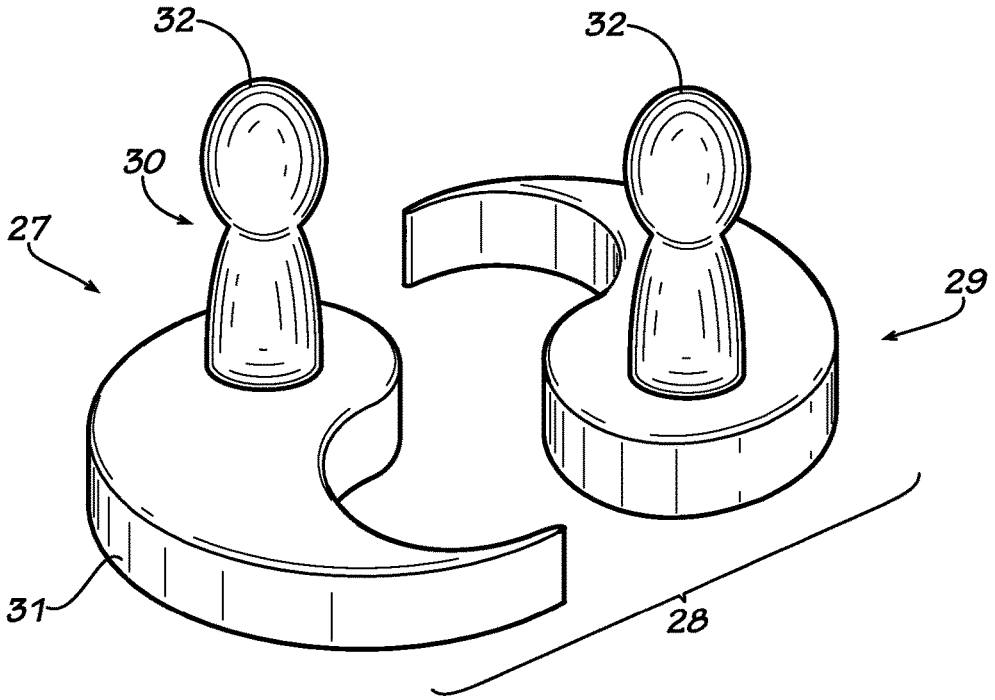
FIG. 3 is a perspective view of the yin/yang game pieces (Pat. No. D711,969)
Figure 4:
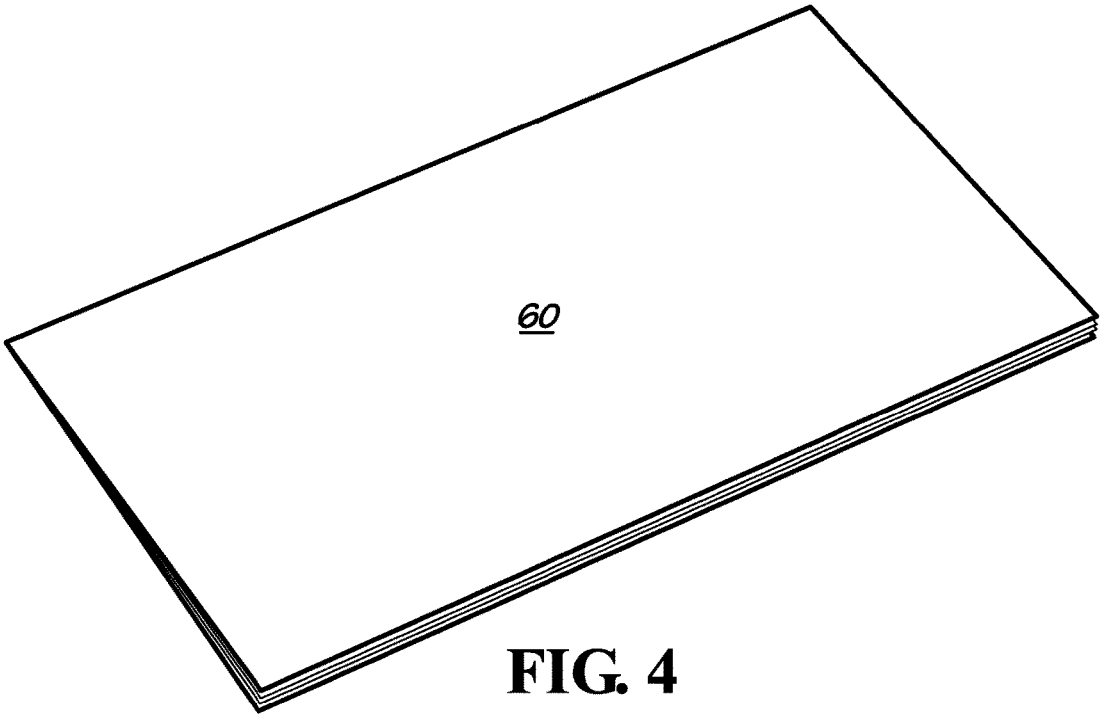
FIG. 4 is a perspective view of the instructions.
Figure 5:
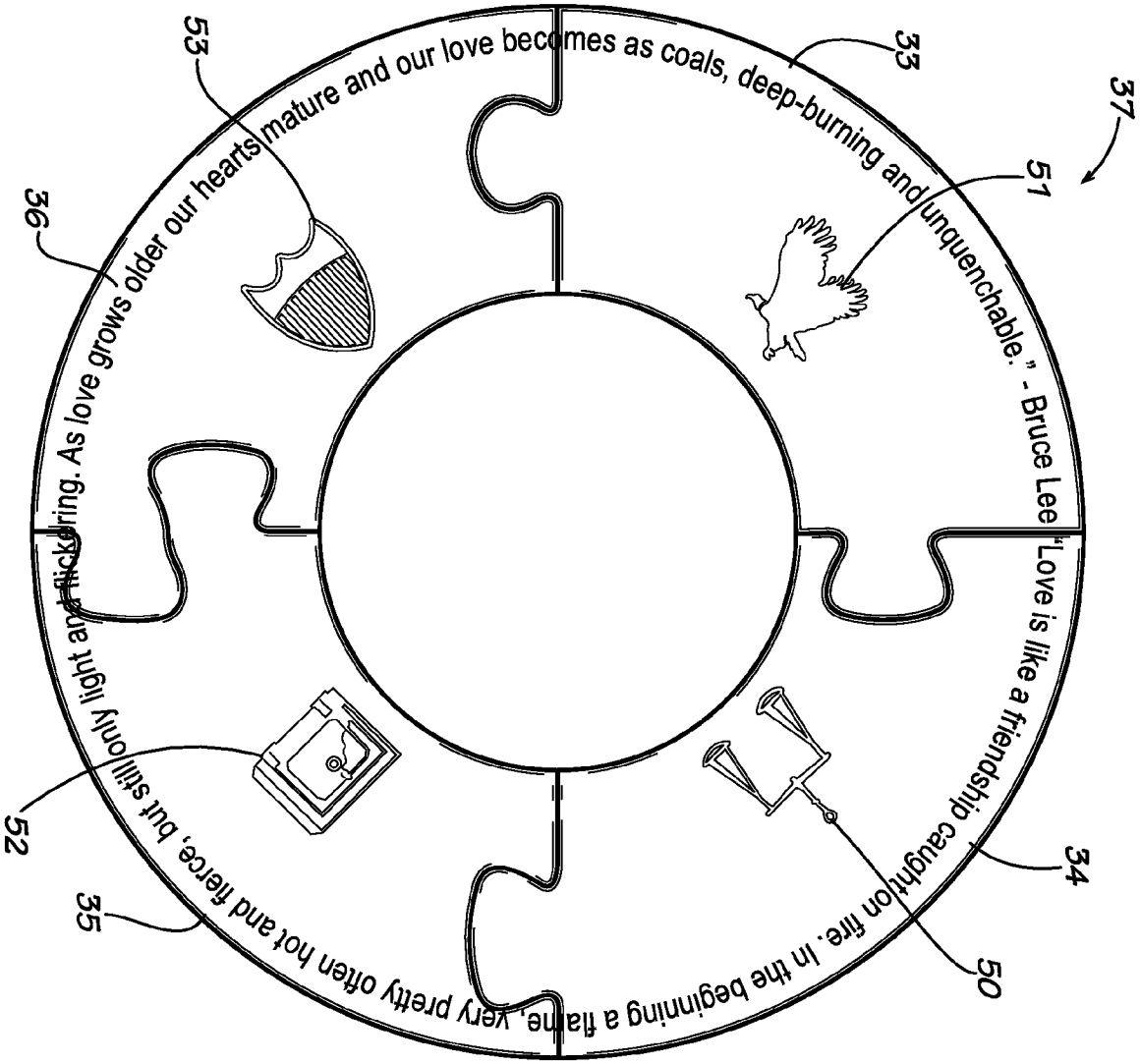
FIG. 5 is a perspective view of the rings.
Figure 6B:
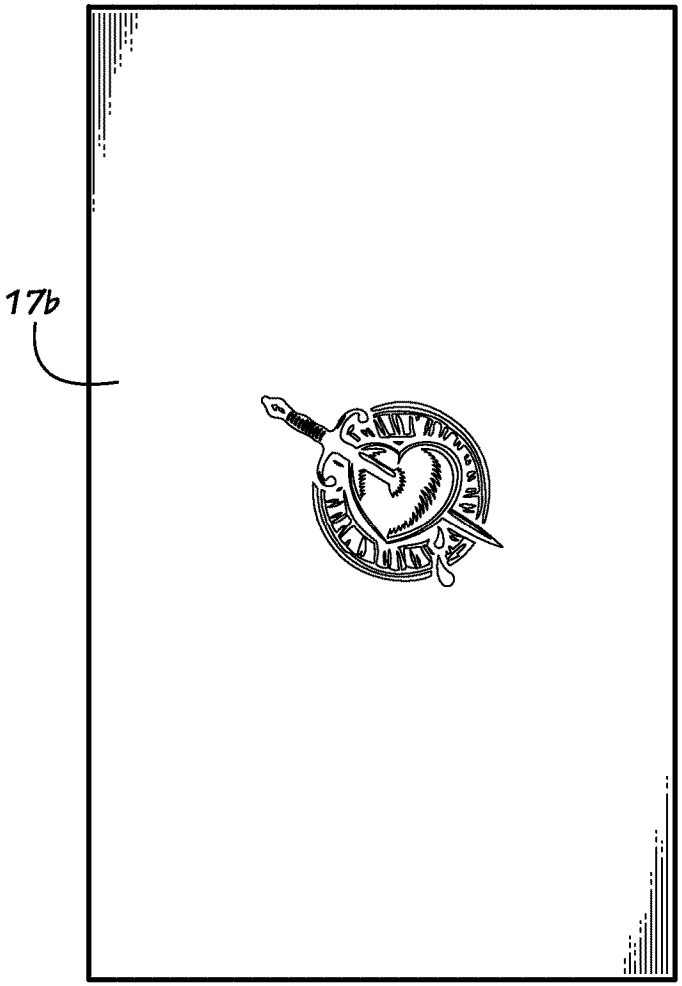
FIG. 6*b* is an overhead view of the back of a Love card.
Figure 6A:
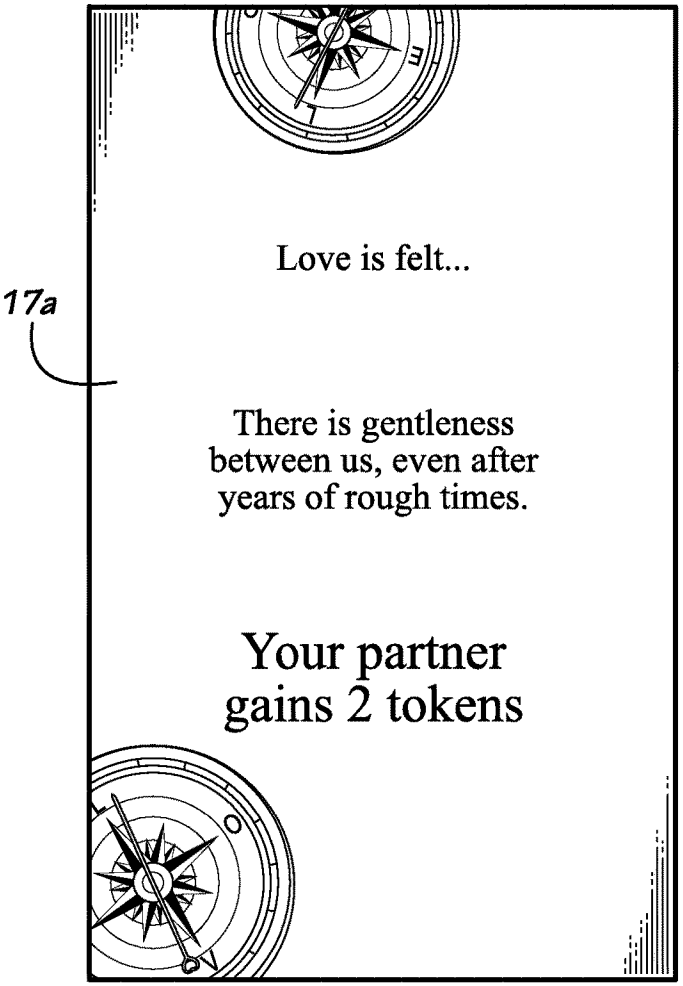
FIG. 6*a* is a frontal view of a front of a Love card.
Figure 7A:
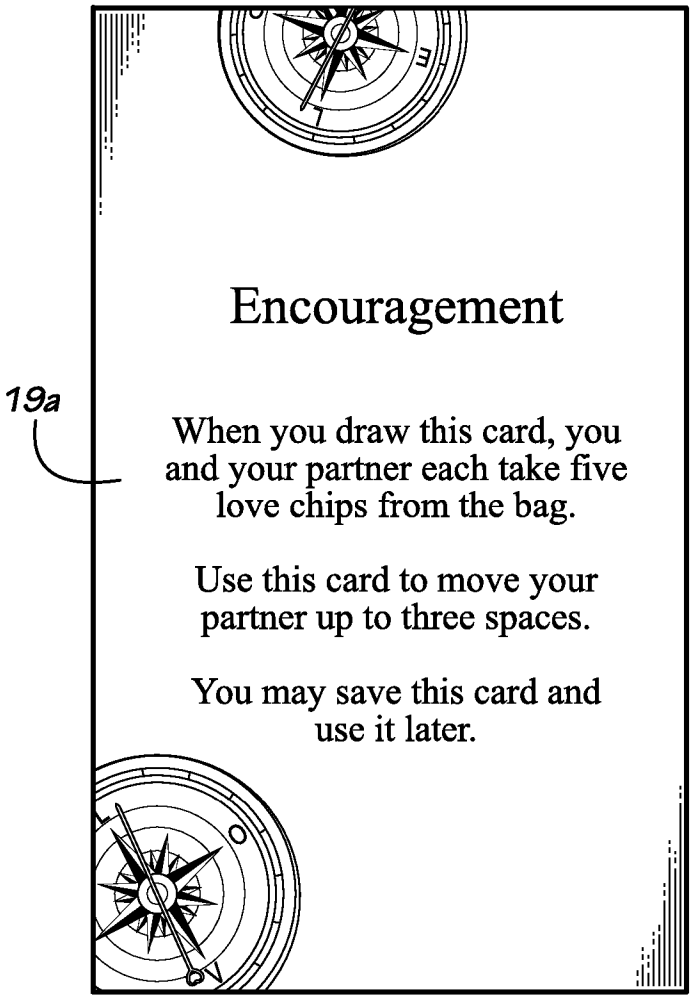
FIG. 7*a* is a frontal view of a front of an Encouragement card.
Figure 7B:
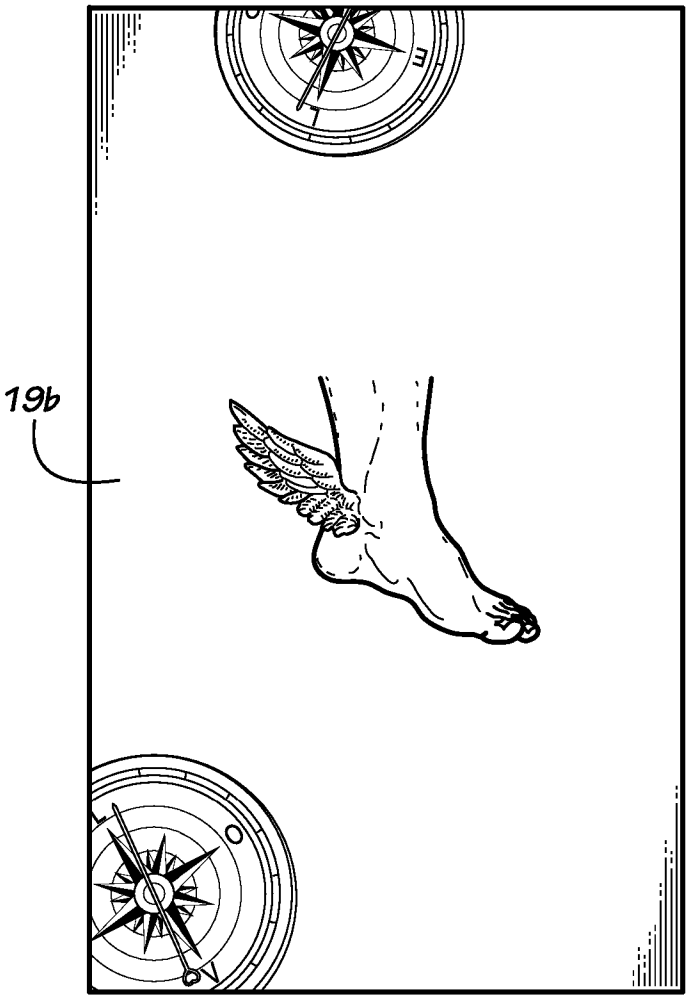
FIG. 7*b* is a frontal view of the back of an Encouragement card.
Figure 8A:
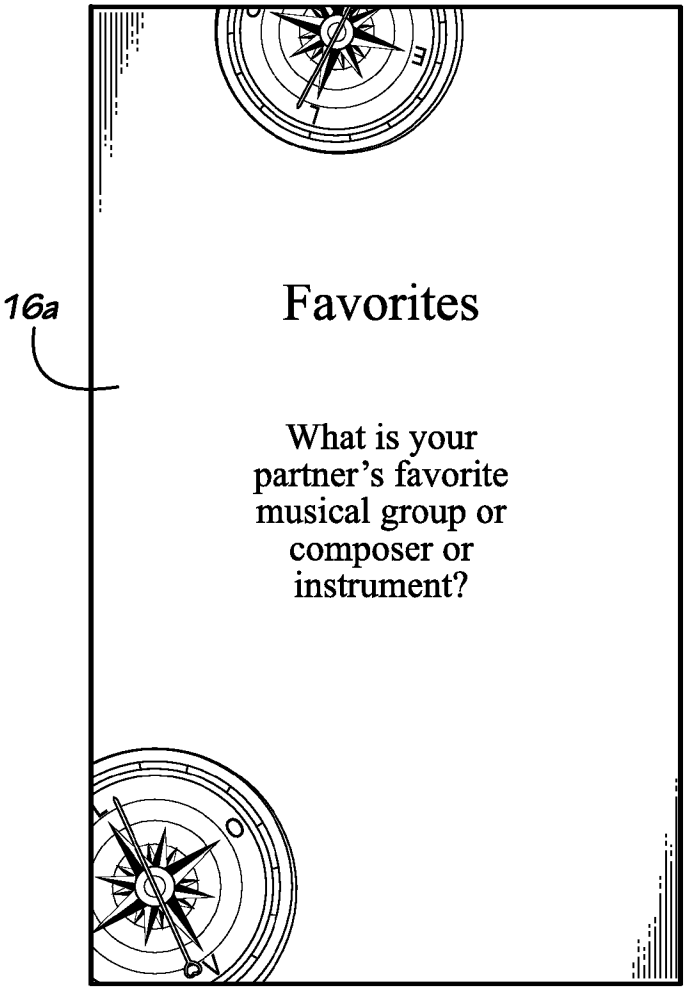
FIG. 8*a* is a frontal view of a front of a Gamble card.
Figure 8B:
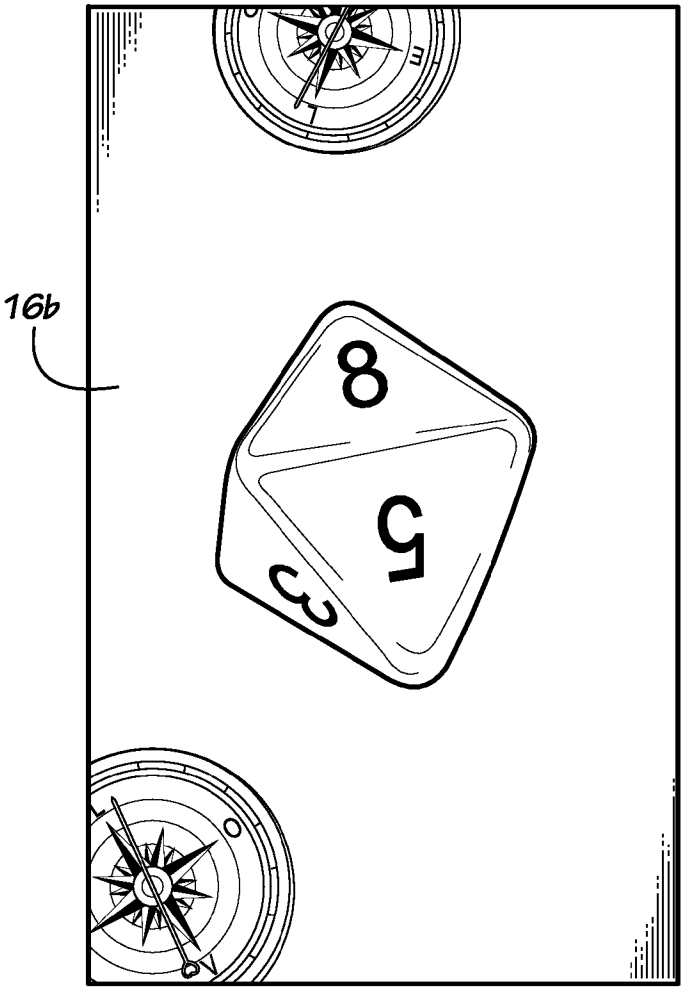
FIG. 8*b* is a frontal view of the back of a Gamble card.
Figure 9A:
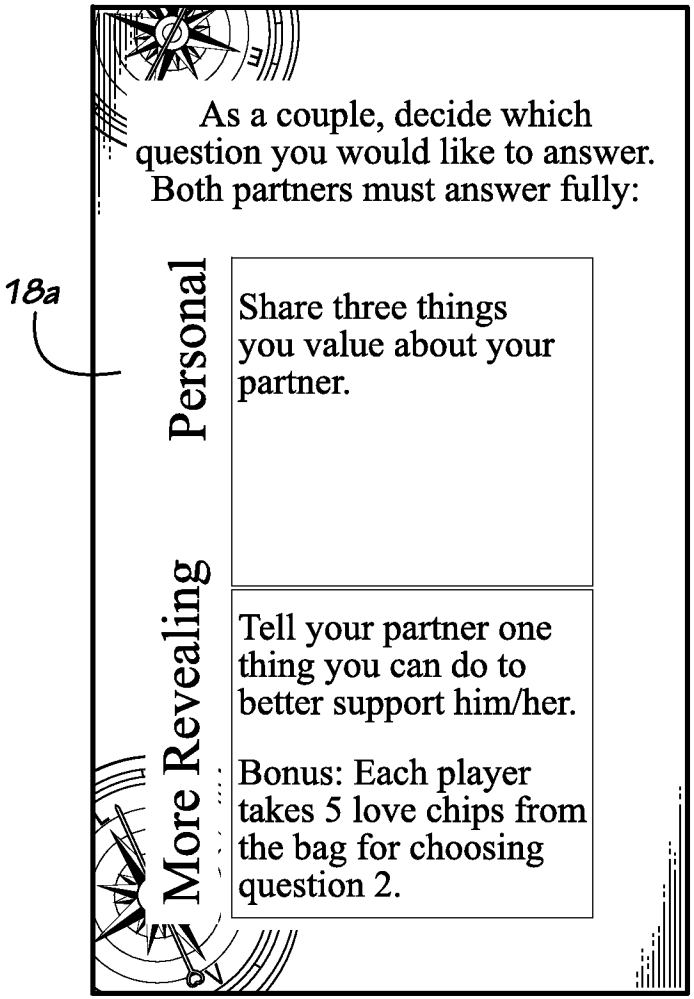
FIG. 9*a* is a frontal view of a front of an Intimacy card.
Figure 9B:
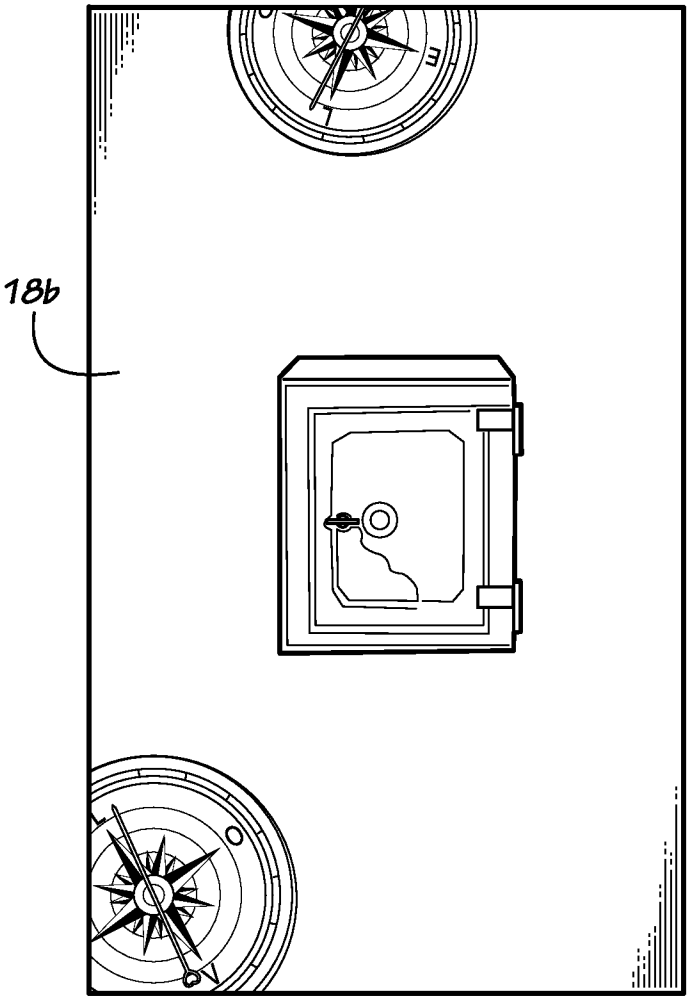
FIG. 9*b* is a frontal view of a Intimacy card.
Figure 10B:
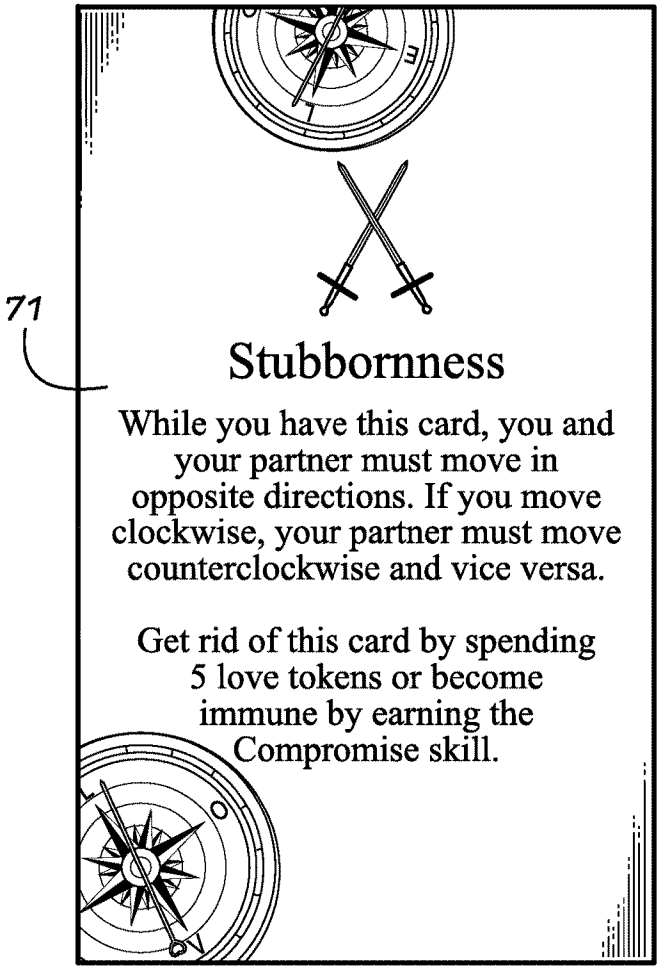
FIG. 10*b* is a frontal view of a Stubborness card.
Figure 10A:
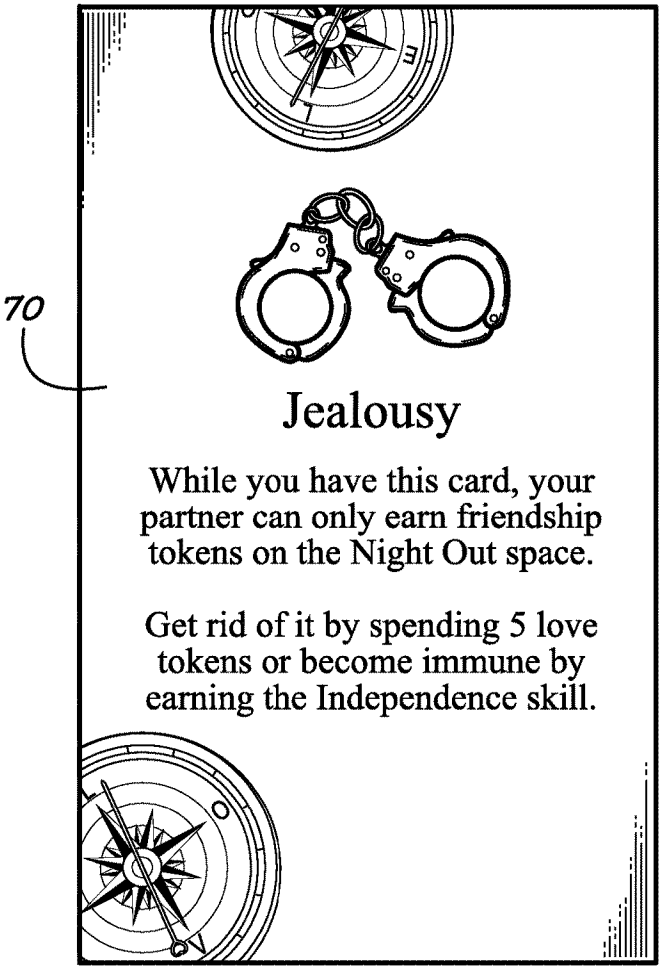
FIG. 10*a* is a frontal view of a Jealousy card.
Figure 10C:
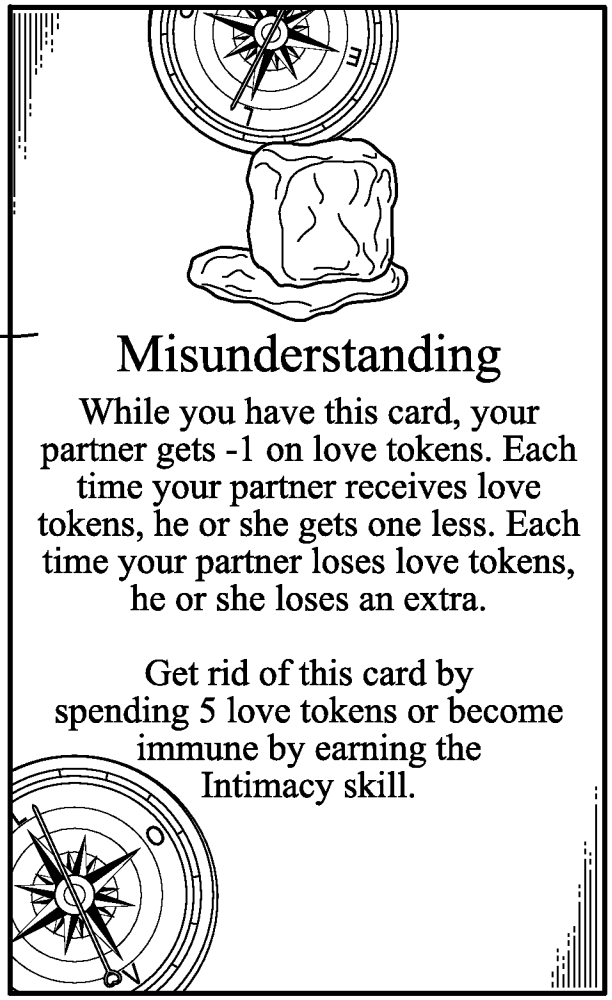
FIG. 10*c* is a front view of a Misunderstanding card.
Figure 10D:
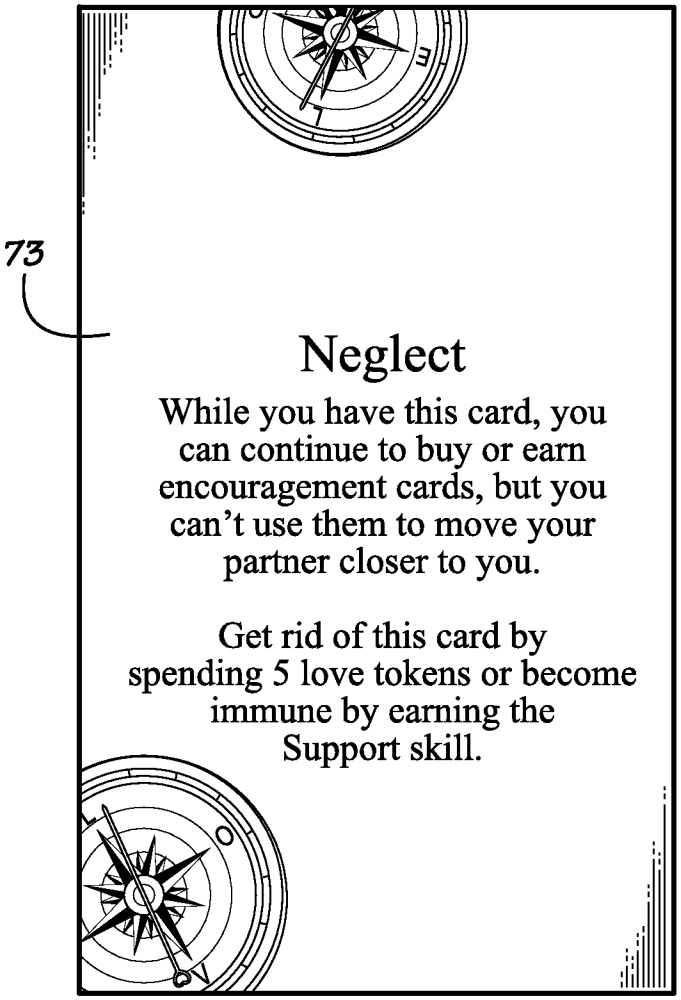
FIG. 10*d* is a front view of a Neglect card.

Referring to FIGS. 1-4, the game 1 comprises a game board 2. The game board 2 is a flat surface with markings on it. In one embodiment, the game board is made of cardboard or paper, or paper 3 on cardboard. A track 4 is printed on the game board. The track 4 may be circular, square, oval, or any other shape, such that the pattern is continuous and closed.

The pattern comprises a plurality of game spaces 5 in which at least one player, or in which two or more players' player pieces will move or land on. On the board are printed a plurality of relationship skills. In one embodiment there are at least three relationship skills. In another embodiment, there are at least four relationship skills 6, 7, 8, 9. In one embodiment, the relationship skills are Compromise, Independence, Intimacy, and Support. There may be fewer or more skill sets than four. In order to win the game, the player or couple must win all four skills or skill sets. In one embodiment each skill set has a particular mark or emblem 40, 41, 42, 43.

Between the relationship skills are other games spaces which are reflective of life and/or relationships. In one embodiment, the spaces include categories such as "Love" 10, "Reignite" 11, "Encourage" 12, "Gamble" 13, "Night Out" 14, and "Doghouse" 15.

In another embodiment, the game board 2 has places or settings for a plurality of different stacks of different game cards. In one embodiment, there are four different stacks or sets of game cards: gamble cards 16; Love cards 17; Intimacy cards 18; and Encouragement cards 19. The cards have a front side 16*a*, 17*a*, 18*a*, 19*a*, and a back side 16*b*, 17*b*, 18*b*, 19*b*. The places or settings 20, 21, 22, and 23 for the cards are either positioned around the board on the outside of the game track 4 in appropriately marked spots or they are positioned on the inside of the track 4. Some of the cards will give instructions to the couple or will have relationship tutorials with orders to either take or remove Love chips or Friendship gems. Some cards, particularly the Gamble cards will ask personal or intimate questions, from which Love chips may be earned or lost depending whether the answer(s) given by one member of the couple agree with the answers of the other member. On the Intimacy cards, players can earn extra Love chips if they choose to publicly answer the more revealing question.

The game also comprises a set of dice 24. These dice 24 may be four, six or eight sided, and may have dots or numbers on each of the sides.

The game includes a set of Love chips 25. The Love chips 25 can be the size of poker chips or they can be larger or smaller. They can be circular or square, and in one embodiment they have the word "Love" printed on them.

The game also includes a set of Friendship gems 26. These gems can be plastic, metal, stone, real gems of gem quality, wood, glass, etc.

The game also includes a plurality of player pieces 27, 29. In one embodiment, the player pieces come in sets of two 28. The player piece 27 has a handle 30. In one embodiment, the handle projects vertically from the base 31. In one embodiment, the handle 30 has a rounded end 32 for the comfort of the user. The base 31 is in the shape of one half of a yin yang image. In a set of complementary player pieces, one of the player pieces 27 is a different shade of the same color as the complementary player piece 29.

The game also comprises a ring 37 made up of a plurality of sections 33, 34, 35, 36. Each section corresponds to a skill set. The ring 37 and hence the ring sections 33, 34, 35, and 36 are comprised of any material, including but not limited to plastic, wood, metal, stone, etc. In one embodiment, the each of the ring sections 33, 34, 35, and 36 have the same markings 50, 51, 52, 53 that correspond to the markings 40, 41, 42, 43 on the skill set on the game board 2. When a couple has earned all of the skill sets they fit the ring 37 together and win the game. The player pieces can then be inserted in the center to indicate their union and win. The game also has a set of instructions 60 printed in an instruction booklet or inside of the box. In other embodiments, there can be other geometric pieces, both 2-D and 3-D that form a geometric pattern or structure when put together.

The skills are earned by collecting Love chips (in a unique colored bag 38) and Friendship gems (in a unique colored bag 39) and by doing things for and with their partner. In more detail the following further define the skill sets:

Compromise—No relationship can succeed without compromise. Successful couples consider each other's needs and forge solutions that are in the best interests of both partners and their relationship.

Independence—Being in Love doesn't mean a person stops being his (or her) self. Successful couples honor their differences and encourage each other to retain their independence.

Intimacy—There's no substitute for feeling close to their partner. Maintaining the fascination a person felt early in his (or her) relationship is a key strategy of successful couples.

Support—Everyone faces challenges. Sometimes, these challenges are individual and sometimes they affect both parties. Successful couples support each other in good times and bad and present a united front to the world.

To set up the game, the Love, Gamble and Intimacy cards are shuffled separately and each pile is placed on the board in the space with the matching icon. The Encouragement cards are placed on the other space and may or may not be shuffled.

Partners select matching pieces (by color shade variations) and place them together on one of the four skills spaces on the board.

Each player takes a turn. They roll both dice, double that number, then fetch the corresponding number of Love chips from the colored bag 38 (e.g., red) and give them to their partner. The more chips a person and his or her partner have, the stronger the presumed relationship getting started, although quantity of chips held does not indicate couple will win.

The game begins with the couple that's been together the longest and continues clockwise. In some embodiments, the game can be continued clockwise or in either direction. During the game, each of the two partners will move on the same turn, but maintain their own separate pile of Love chips and Friendship gems, which cannot be shared except when earning the Compromise skill. At the start of one player's (of one couple) turn, both individuals of the couple each take one Love chip from their own pile (representative of the gradual chipping away of our Love if nothing is done to replenish it in our relationship) and put it back in the common pile (or bag or bank, as it may be known). Each partner can move clockwise or counterclockwise depending on the role of their dice to a desired landing location; the objective of the game is to always come together with your partner in one of the relationship skill landing places.

At any point in the game, a person can exchange two Friendship gems for one Love chip or two Love chips for one Friendship gem. The idea of exchanging two Friendship gems for one Love chip is that if a person's relationship with their partner is suffering, sometimes that person needs to spend less time with their friends and more time protecting and reigniting their Love; exchanging Love chips for Friendship gems is the reverse where more Independence is needed. Alternatively, if a person does not have any Love chips, they move their own, and their partner's playing piece to the Doghouse space, whereupon neither can take a turn until both are out of the Doghouse. To get out of the Doghouse, both of the partners roll both dice. Roll evens and earn two Love chips from the bag and a chance at redemption. Roll again and take a turn as usual. Roll odds and you'll need to try again on the next turn.

There are a number of ways to earn more Love chips. They are:

At the start of the game.

When one or both of the partners lands on an Encouragement space (five chips).

When a player lands on any space with their partner (four chips).

When a partner draws a Love is Felt card.

When a partner successfully answers a trivia question about their partner found in the Gamble cards.

When two Friendship gems are traded for one Love chip at any time in the game.

A player can also lose or spend Love chips. The ways to lose chips include:

Spend one per turn for the chance to play.

Pay the price for a partner's weaknesses on the Love is Weakened cards.

A player unsuccessfully answers a trivia question about their partner found in the Gamble cards.

One of the partners can spend five Love chips at the start of any turn to get rid of a Negative Emotion card.

One of the partners can spend five Love chips at the start of any turn to buy an Encouragement card.

At the beginning of each turn, each of the two partners rolls one of the dice and moves that many spaces in either direction. The goal is for a person to land on a skill space with their partner but good things can happen if a player lands on any space with any other player. The two partners should work together to figure out who moves where.

If a player lands on a skill space, within three spaces of their partner, they can use an earned Encouragement card to pull them closer to their partner. Two Encouragement cards can be used to move the partner up to six spaces. A player can get an Encouragement card each time one of two partners lands on the Encouragement space. Alternatively one can buy an Encouragement card by spending five Love chips at the start of any turn. Once the Encouragement card is used, it is returned to the deck.

If player lands on a space with another player, bonuses are granted in the form of Friendship gems equal to the number of players on the same space (couples earn double the amount of Friendship gems if they land on the same space).

If a player lands on a skills space with their partner, they should try to earn that skill (if they have not earned it already). For example, to earn the Compromise skill, both partners elect to sit out the game for three consecutive turns. Each player still hast to turn in the Love chips for each missed turn, but the two players (partners) don't roll and don't move (this is symbolic of a petty sacrifice that is often required in a relationship). On the third turn, all of the Love chips and Friendship gems are combined and divided equally; and if there is an odd number, an extra chip and/or gem are taken from the bag to make each partner's quantity equal. Once the skill is earned the couple receive the same colored connector skill piece named Compromise. If the partners have earned this skill, they are not affected by Stubborness.

The Independence skill can only be earned by accumulating enough Friendship gems by meeting up with friends around the board. Both of the partners must each spend ten Friendship gems to earn this skill. Once the skill is earned the couple receive the same colored connector skill piece named Independence. If both of the partners have earned this skill it is representative of the fact that they are not affected by Jealousy 70 and they each can be independent.

To earn the Intimacy skill, an Intimacy card is drawn which has two questions on it. The partners decide which of the two questions on the card they wish to answer publicly to each other. One of the questions on each card is more revealing that the other question so additional Love chips may be earned with the more revealing card. Once the players have shared their answers with their partner publicly they earn the Intimacy skill and the couple receives the same colored connector skill piece named Intimacy. By earning the Intimacy skill, the couple is not affected by Misunderstanding and have demonstrated that they do have Love for each other.

The fourth skill required to win the game is Support. For three consecutive turns, both of the partners combine their rolls and move around the board together. If the couple happens to land on another skills space, they can work that second skill also. Once the skill is earned the couple receive the same colored connector skill piece named Support. If the Support skill is earned, the couple is not affected by Neglect and have demonstrated that they can work together.

Each time a skill is earned the couple takes the corresponding skill connector and uses it to build the respective part of the puzzle. In one embodiment of the disclosure, the color of the skill connector is the same as the color of the skill printed on the board.

During the course of the game, there are a number of ways to earn extra Love chips. In one embodiment, if a person and their partner land on a skill that they have already earned, they each earn four Love chips. In another embodiment, if a person lands on any other space with their partner, they each earn four Love chips. If a player lands on a space with a player who isn't their partner, each person earns two Friendship gems. If they land on a space with two players who aren't their partner, they each earn three Friendship gems, and so on.

In one embodiment, if a player lands on a Love space, that player draws a card from the Love pile of cards. If the player gets a "Love is Felt" card, the card is read aloud and his/her partner takes the indicated number of chips from the bag or bank. If a player gets a "Love is Weakened" card, the card is read aloud, and his/her partner takes the indicated number of chips from his or her pile and gives them back to the bank (place them in the bag). This concept of the partner gaining or losing Love Chips when the player lands on a Love space is indicative of how our partner gains or loses from our actions. If a player gets a negative emotion card, like Jealousy 70, Stubbornness 71, Misunderstanding 72, or Neglect 73, the card is placed in front of the player, and the couple has to earn their way out of the negative card zone. It is important that the couple get rid of the "negative" emotions card as fast as they can, because such cards make it much harder to complete the game.

The idea behind a couple earning their way out of a "negative emotions" card is that negative emotions stick around, draining the "juice" out of any relationship over time.

The Jealousy card is a reminder that jealousy is a prison for both members of a couple. In healthy relationships, both partners enjoy relationships with other people, including family and friends, and both members are prevented from developing other relationships. Consequently, when a person has this card, their partner can only earn Friendship gems on the Night Out space. Alternatively, five Love chips can be spent or the couple can become immune from jealousy by earning the Independence skill.

The Stubbornness card represents the act of stubbornness, the artificial state of competition and defensiveness that makes one's partner the enemy. While the stubbornness card is held each partner must move exactly the opposite around the board (i.e.—one moves clockwise and the other one counterclockwise). A player can rid themselves of this card by paying five Love chips to the bank or by becoming immune earning the Compromise skill.

The Misunderstanding card represents the failure of a person to go out of their way to listen deeply to their partner, and thus misunderstanding results. When a partner has this card, their partner gets one less Love chip when they receive Love chips from any action on the board. When the partner loses Love chips from any action on the board, he or she loses one extra. The way to get rid of the card is to pay five Love chips to the bank or become immune by earning the Intimacy skill.

A Neglect card is representative, of neglect, of course. If a partner is not paying attention, he or she can't know when their partner needs a little extra support. While the Neglect is held, a player can continue to buy or earn Encouragement cards, but they can't be used to move the player's partner closer to them. The player can get rid of the Neglect card by paying five Love chips to the bank or can become immune by earning the Support skill.

If a player draws a negative emotion card they already possess, they are to return it to the bottom of the pile.

If a player lands on an Encouragement space, both of the partners (both members of the couple) can take five Love chips from the bag. An Encouragement card is also taken from the pile. As noted above, the Encouragement card can be used to move a partner closer to their partner on the board.

If a player lands on the Night Out space by himself or herself they share something that they value about their partner with the other players. However, if another member of another team lands on the space, each get double the Friendship gems. If a player and player's partner land on the Night Out space, they can try for a skill of their choice by moving their player pieces to the appropriate skill If a player lands on the Gamble space, his/her partner draws a Gamble card and tells his/her partner the category of the Gamble trivia card, which could be Favorites, Secrets & Habits or History. The player who landed on the Gamble space then declares how many of their partner's Love chips he or she is going to risk on knowing the answer to the trivia question. The partner then reads the question on the Gamble card. The player who landed on the space writes the answer down on a piece of paper in a manner that no one else can see. Once the answer has been written, the partner reading the card shares his/her answer to the question and this is compared publicly to the answer written. If the answer is correct, the risked number of chips are taken from the bank bag and given to the partner. If the answer is incorrect, the partner loses the amount of Love chips gambled to the bank. If a partner refuses to answer they lose double the amount of Love chips gambled to the bank.

If a player lands on the Reignite space, the player and his/her partner can go for a Clean Sweep. In a Clean Sweep, the dice are rolled and if an even number is rolled all of the negative emotion cards that are affecting both members of a team, and that have been acquired during the game, are removed.

Alternatively, the player who lands on the Reignite Space moves to the nearest Night Out space, and rolls the dice. If the roll results in an even number, their partner can join him/her on the skill space of their choice. If an odd number is rolled, the player is "stood up."

A player can also end up in the Doghouse space by the roll of the dice. There is no penalty for landing in this space although the player should share something publicly that they appreciate about their partner.

The Love Adventure Board Game can be played by one couple in a private setting. All of the same rules apply except:

Each partner take turns each using one of the dice. The dice are rolled to see who goes first.

Each partner may start on the same space or different spaces although no Friendship gems are earned by starting together on the same space.

To earn the Compromise skill both of the partners will think of something in their relationship that they are willing to bend on and make that commitment to their partner.

Many modifications and variations of the present disclosure are possible in light of the above teachings. It is, therefore, to be understood within the scope of the appended claims the invention may be protected otherwise than as specifically described.

We claim:

1. A board game for teaching relationship skills to one or more couples, said game comprising:

a game board having a plurality of spaces defining a game track, said spaces including marked spaces depicting a plurality of relationship skills;

a set of dice;

a plurality of love chips;

a plurality of friendship gems;

a plurality of game pieces, each game piece comprising two complementary player pieces having interlocking bases and said bases, upon interlocking, defining an outer periphery of the game pieces;

a plurality of skill connector pieces, each skill connector piece having markings corresponding to one of said relationship skills depicted in said marked spaces; and a plurality of instructional game cards, wherein said skill connector pieces define jigsaw shaped puzzle sections configured to interlock with one another, wherein said jigsaw shaped puzzle sections, when interlocked in a proper sequence, form a ring-shaped puzzle having a center opening, and wherein the outer periphery of said game pieces is configured to fit within the center opening.

2. The board game of claim 1, wherein the relationship skills depicted by said marked spaces are skill sets relating to Compromise, Independence, Intimacy, and Support.

3. The board game of claim 1, wherein each of said interlocking bases is shaped as one half of a yin-yang image, and wherein a handle is attached to each said base, said handle being perpendicular to a surface of said base.

4. The board game of claim 3, wherein said interlocking bases are configured to interlock as yin-yang within the center opening of said ring-shaped puzzle, and wherein said yin-yang interlocking of player pieces within the center opening signifies a couple's union.

5. The board game of claim 1, wherein one of said complementary player pieces has a color and the other of said complementary player pieces has a different shade of the same color as the one complementary player piece.

6. The board game of claim 1, wherein said plurality of instructional game cards includes plural sets of game cards, and wherein said sets of game cards include Love cards, Gamble cards, Intimacy cards, and Encouragement cards.

7. The board game of claim 1, wherein said spaces defining the game track include further marked spaces depicting a plurality of reflective life skills, and wherein the reflective life skills include skills of Love, Reignite, Encourage, Night-out and Doghouse.

8. The board game of claim 1, further comprising at least two colored bags, one for collecting the love chips and the other for collecting the friendship gems during play of the game.

9. The board game of claim 1, wherein each of said jigsaw shaped puzzle sections comprises a segment of said ring-shaped puzzle, wherein each segment has a peripheral edge and includes part of a love caption adjacent the peripheral edge, and wherein said segments, upon being interlocked in said proper sequence, render the love caption in its entirety readable.

10. The board game of claim 1, wherein the love chips have a square or circular configuration.

11. The board game of claim 1, wherein the friendship gems are selected from the group of materials comprising plastic, metal, stone, wood, glass, and real gemstone.

12. The board game of claim 1, wherein the jigsaw shaped puzzle sections are selected from the group of materials comprising plastic, metal, stone, and wood.

13. The board game of claim 1, wherein the ring-shaped puzzle formed by the interlocking jigsaw shaped puzzle sections is representative of infinite love and/or a couple's bond.

14. The board game of claim 1, wherein the game track is a continuous circular track and the game board has marked spots positioned outside the circular track for placement of the instructional game cards.

15. The board game of claim 14, wherein couples playing the game are afforded an opportunity to earn one or more of the relationship skills depicted in said marked spaces and receive the corresponding marked jigsaw shaped puzzle section associated with acquisition of the relationship skill by:

selecting a set of said complementary player pieces, placing the selected set on a space of said circular track, rolling said dice, and moving each player piece of the set clockwise and/or counterclockwise along said circular track until each player piece lands on one or more of the marked relationship skill spaces together.

16. The board game of claim 15, wherein the game is won when one couple's player pieces land together on each marked relationship skill space; the one couple earns the relationship skill associated with each marked space; and the one couple takes the jigsaw shaped puzzle sections corresponding to the respective acquisition of relationship skills and uses the sections to build the ring-shaped puzzle.

* * * * *